US005439313A

United States Patent [19]

Blaha et al.

[11] Patent Number: 5,439,313

[45] Date of Patent: Aug. 8, 1995

[54] SPRAY PATCHING PAVEMENT REPAIR SYSTEM

[75] Inventors: James R. Blaha, Evanston; Herbert N. Underwood, Chicago; Ralph Salle, Lake Zurich; Ronald R. Ralston, Elmhurst, all of Ill.

[73] Assignee: Northwestern University, Evanston, Ill.

[21] Appl. No.: 238,151

[22] Filed: May 3, 1994

Related U.S. Application Data

[62] Division of Ser. No. 34,506, Mar. 19, 1993, Pat. No. 5,333,963.

[51] Int. Cl.[6] ..... E01C 19/00

[52] U.S. Cl. ..... 404/75; 404/80; 404/101

[58] Field of Search ..... 404/84.1, 102, 120, 404/74, 75, 90, 72, 107; 15/347, 340.1

[56] References Cited

U.S. PATENT DOCUMENTS

| | | | |
|---|---|---|---|
| 1,747,125 | 2/1930 | Murphy | 404/27 |
| 1,981,241 | 11/1934 | McWilliams et al. | 160/117 |
| 3,905,621 | 9/1975 | DeMarco | 285/7 |
| 4,036,614 | 7/1977 | DeMarco | 55/310 |
| 4,062,664 | 12/1977 | Dupre et al. | 55/319 |
| 4,111,670 | 9/1978 | DeMarco | 55/315 |
| 4,174,206 | 11/1979 | Dupre et al. | 55/434 |
| 4,274,802 | 6/1981 | Inaba et al. | 414/730 |
| 4,376,007 | 3/1983 | Eigenmann | 404/72 |
| 4,557,626 | 12/1985 | McKay et al. | 404/102 |
| 4,578,840 | 4/1986 | Pausch | 15/340.1 |
| 4,630,929 | 12/1986 | Medlin | 366/10 |
| 4,655,676 | 4/1987 | Jannborg et al. | 414/730 |
| 4,744,693 | 5/1988 | Smith | 404/79 |
| 4,798,530 | 1/1989 | Sestrap | 431/354 |
| 5,044,819 | 9/1991 | Kilheffer et al. | 404/72 |
| 5,059,061 | 10/1991 | Stenemann et al. | 404/72 |
| 5,111,709 | 5/1992 | Torii et al. | 74/89.15 |
| 5,122,025 | 6/1992 | Glomski | 220/1.5 |

OTHER PUBLICATIONS

Popular Science, Feb. 1992.
Los Angeles Times, "Lab Developing Machines That Eats Street Potholes", Jul. or Aug. 1991.
Chicago Sun-Times, "Potholes," Jun. 27, 1991.
Crain's Chicago Business, "Lethal Artillery In Pothole War," Jun. 24, 1991.
BIRL Progress, Jun. 1991, pp. 1, 5 and 6.
Duraco Industries, Inc., product brochure for Dura Patcher.
Brochure describing "The Patcher," undated.
Article in Roads & Bridges describing "PUFF" Asphalt Maintenance Systems, dated Mar. 1992.

*Primary Examiner*—Ramon s. Britts
*Assistant Examiner*—Pamela A. O'Connor
*Attorney, Agent, or Firm*—Willian Brinks Hofer; Hugh A. Abrams

[57] ABSTRACT

An automated pavement repair vehicle includes a vehicle and its various computer-controlled subsystems. The various subsystems, including a vacuum system, heating system and spray patch system, for completing pavement repair, are located on the frame and rear of the truck. A robotic cell at the rear of the truck includes an assembly of retractable doors. The doors are lowered around the pothole to allow control of ambient conditions during the pavement repair procedure.

13 Claims, 8 Drawing Sheets

SPRAY PATCHING PAVEMENT REPAIR SYSTEM

This application relates to the subject matter of United States government contract no. SHR-89-H107B. The invention was made with United States government support and the government has certain rights in the invention.

This application is a division of application number 08/034,506 , filed Mar. 19, 1993 , now issued U.S. Pat. No. 5,333,963.

SPRAY PATCHING PAVEMENT REPAIR SYSTEM

BACKGROUND OF THE INVENTION

The present invention relates to the repair and resurfacing of pavement. The invention includes a vehicle and its various subsystems, which perform the pavement repair. The invention also includes novel and improved methods of pavement repair. The techniques and concepts of the invention have widespread application to various apparatus and methods used in pavement repair, as well as pavement construction and surfacing.

CAUSES OF POTHOLES IN PAVEMENT

Potholes, and other pavement surface failures and defects, are a prevalent problem, affecting pavement and roads in every state, as well as Canada and other parts of the world. The widespread nature of pothole defects are a result of the basic causes of pavement failure and the generally primitive methods yet available to repair the problem. Potholes are mainly an asphalt-surfaced pavement surface distress that can be encountered over the entire road surface. Potholes may be closely spaced or infrequent over a road system.

Asphalt-surfaced roads come in several varieties. Asphalt pavements are designed with a view to the loading encountered on the road surface, the surrounding soil conditions, and the environmental conditions. The load is transmitted through the top asphalt layer into the base and subgrade materials, so these structures must be stable and free of water for good performance of the asphalt. Pancake pavements are designed for light loads and consist simply of a thin asphalt layer on gravel base. More heavily traveled roads are constructed of a thicker asphalt layer on a gravel base which rests on a subbase of lesser quality gravel. Both of these constructions are flexible so that load vectors will fan out through the base materials. A rigid base pavement however carries the load throughout the whole Portland cement base layer, which flexes mainly at the joints or cracks. The top asphalt layer must also flex at those points. Consequently, cracks or failures often show through the asphalt layer with the result being the potential start of a pothole.

Potholes are structural failures caused by loading and weakening of the base or subbase. Loading is primarily a result of traffic along the pavement, but weakening can result from several causes. Poor materials, poor construction, or poor drainage are usually at fault. Water in particular has the potential to ruin a pavement in a short time. Potential water damage necessitates improving the drainage around a pavement in order to lengthen the life of the road. The weakened areas bend more than normal, particularly with heavy loading, and cause cracks to appear on the surface.

The defect begins to form as water enters the system and begins to saturate and further deteriorate the base. In freezing weather, the water may turn to ice and expand the cracks or separate the asphalt layer from the base. Traffic action, which exerts downward force (deflection) as well as side force (shear), dislodges pieces of the surface and exposes the base layer to the elements. Without the asphalt layer for protection, the base rapidly erodes and complete failure results.

A rigid base pavement develops potholes in a different way, but the results are the same. Since a rigid base flexes at joints and cracks, the asphalt surface may also develop a crack. When water or incompressible particles find their way into the crack and down into the base, the freedom of movement is hampered and spalling (potholing) will result. Additional stresses and strains cause further cracking which accelerates the problem. If the cracks are not cleaned and sealed quickly, sections of the asphalt may peel away exposing the base. Deteriorated concrete bases can also lead to potholes. Corroded reinforcement bars (from deicing chemicals or induced electric currents) or poor construction are often to blame for deteriorated bases.

Standard Pothole Repair Materials

Presently, pothole repair is typically performed with either a hot bituminous (asphalt) material ("hot mix"), a cold emulsified material ("cold mix"), a polymer-modified cold mix, or a hybrid cold mix that is created during dispensing sometimes called "spray emulsion". More recently, two component epoxy materials have also been used. There are hundreds of individual formulations within these broad categories.

Patching mixtures must develop certain properties in order to perform well. The properties sought in patching materials include: (a) stability or resistance to shoving and rutting; (b) adhesion for bonding to the sides and bottom of pothole; (c) binder resistance to stripping in the presence of water; (d) durability or resistance to deterioration caused by traffic and climate; (e) workability or ease of handling, shoveling, and compacting; and, (f) long-term storage life without reduced workability.

Standard Pothole Repair Procedures

The current application methods naturally differ for the three materials due to heating requirements of some, material handling properties, weather conditions, and pothole conditions.

Hot Mix Application

Heated bituminous mixtures require intensive cavity preparation to ensure adequate patch life, as hot mixes are typically applied in warm, dry weather. While the material is currently the least expensive of those available, hot mix may be more costly in the long run because of the labor required and the further cost associated with a poorly prepared hole (such as those done in emergency conditions or in haste) which may result in very rapid failure. The patch consolidation occurs with cooling and compaction. Generally, the following steps are performed by a foreman and a crew of 7 equipped with a dump truck holding the heated mixture (or a 'hot box'), an impact or abrasive pavement cutter, heated oil tanks, brooms, shovels and lutes, and a mechanical compaction device.

1. The foreman surveys and marks pavement surrounding pothole, identifying it for removal.

2. The pothole is cut with a jackhammer from the inside out to the marked outline, trying to cut vertical sides to a depth of solid pavement. If a saw is used, the outline is followed in a series of straight cuts.
3. The cavity is cleaned with brooms and then air is blown through a pipe, if available.
4. The cavity surfaces are then coated with heated tack oil, using brooms or a spray wand. An even coating of oil must be placed on all surfaces.
5. Hot mix is shoveled or dumped into cavity and spread with shovels and brooms into all areas. Hot mix is continually applied and built up to a level of 1 inch above surrounding pavement level for each 4 inches (approximately) of the cavity depth.
6. The hot mix is leveled-off evenly with a lute or broom in preparation for the compactor.
7. The hot mix is cleaned from the surrounding pavement.
8. The hot mix filling is compacted with a rolling compactor, by making passes along the outside edges, and then working into the middle. Final passes are made over the entire hole working transversely to road so that the wheel ruts do not cause bridging. Ten to fifteen passes must be made quickly before the hot mixture cools and hardens. A vibratory mode should then be engaged when over the hole. The finishing passes should leave the mixture about ¼ inch above surrounding pavement for resistance to water penetration and also allowing traffic to compact further without creating depression. The density should be preferably at least 95% or about 140 lbs per cubic foot.
9. The edges of the patch are then seal coated with a suitable compound applied with broom or spray wand.
10. An optional last step is the dusting of the surface of the patch with sand, or fine aggregate or crushed rubber particles, in order to allow immediate drive-over.

Cold Mix Application

Cold mixtures are designed for application in more adverse weather conditions. Patches can be made with less intensive cavity preparation, but result in shorter patch life. The cold mix material is moderately expensive compared to hot mix material, but it may be more costly in the long term on account of the short life term of the cold mix patches. Many different states, notably Illinois, Minnesota and Pennsylvania, have developed their own cold mixes that have relatively good lifetime and storage properties. Patch consolidation occurs with compaction, time, and exposure to the elements.

Generally, the same series of steps as described above for hot mix application are performed by a foreman and a crew of 5 to 7 equipped with a dump truck holding the cold mixture, an impact or abrasive pavement cutter, heated oil tanks, brooms, shovels and lutes, and a mechanical compaction device. However, surveying and marking are not necessary since there is no cutting. Tacking of the cavity with heated oil is also not utilized. Compaction of the cold mix material is accomplished after the filling using truck tires or by striking it repeatedly with back of shovel. A final seal coat is not used. Most products using cold patch assert that immediate drive-over is possible, but typically the patch will remain soft for one to three days.

Spray Emulsion/Aggregate Application

About 15 years ago, a patching technology emerged that is often called spray emulsion/aggregate. The industry developed a patching method (and a product called a spray patcher) that keeps the asphalt binder in liquid form and separate from the aggregate until the moment it is needed. The liquid asphalt emulsion, typically a colloid of asphalt and water, is sprayed onto the surface of the aggregate so that it becomes well coated and able to bond to other aggregate particles to form a stable patch. The emulsion cures by the action of the asphalt coming out of suspension and forming a coating on the rock.

The asphalt industry has spent many years attempting to eliminate the difficulties of handling asphalt emulsion and rock aggregate. The overwhelming conclusion of the industry is that is that asphalt emulsion and rock aggregate should be separated as long as possible. Since the spray patch materials are not combined until needed, there is minimal waste of the components, and there is opportunity to custom tailor the proportional mixing to suit the local customs and patching conditions. There is also no need to dump unused spray patching materials at the end of a workday or before a long weekend; with premixed materials such dumping of unused materials is a necessity.

The basic principal of spray emulsion is set forth in prior art patents, such as U.S. Pat. No. 4,630,929 to Medlin. A hopper contains a quantity of aggregate (⅜" diameter, crushed limestone is typical) that can be dispensed by some means into a feeder mechanism. From the feeder mechanism the rock enters an airstream where it is entrained and moved down a hose or pipe to a position near and above the pothole. As the aggregate is conveyed by the air, it picks up velocity until terminal speed is reached. Just before the aggregate is discharged from the hose or pipe at the delivery nozzle, it is sprayed with a mist or stream of liquid asphalt emulsion discharged from a heated storage tank.

The patch material is thus created by the combination of asphalt emulsion and rock aggregate. Its high velocity causes the individually coated rocks to impact the road surface with enough force to stabilize the patch as it is placed. Air voids are eliminated from the patch as it is built from the bottom of the pothole to the top. The aggregate is bound and interlocked together by the matrix of the asphalt as it cures from the impact, temperature change, and exposure to the elements.

The presently-available commercial systems all employ variations on this basic design, yet as presently known and understood, none control the process to assure that critical set points are maintained or optimize the procedures to the individual requirements of a pothole. The quality of the road repairs performed with this technology are still heavily dependent of the skill of the equipment operators holding the nozzle and moving it back and forth across the pavement. The emulsion and rock flows are established by mechanical valves and electrical switches. Sequencing of the valves and switches is critical to maintain the appropriate spray pattern. Proper proportional mixing of the emulsion and aggregate is required for long patch life times.

Aggregate velocity is usually a fixed parameter in the prior art designs. However, aggregate velocity is critical in achieving tight spray patterns, minimizing bounce-back, and causing the initial cure of the patch material as it impacts the road. A two to three person crew is often used in the prior art systems, with the equipment mounted on a trailer and hauled by a dump truck holding the aggregate. Some integrated vehicles exist, but their capacity is quite limited. No sensors or computer control, as used in the present invention, is known to be available on any commercial system. Neither do these systems integrate other tools for the preparation of a pothole before filling with the spray patch process. Furthermore, the commercial systems do not employ sensing technology to determine pothole conditions, qualify the repair process, nor validate proper repair.

The present invention utilizes a spray emulsion/aggregate system that is entirely computer controlled and operated by robotics. Process control technology is used to synchronize the emulsion and aggregate flows and ratios. A computer vision system determines the geometry of the pothole and calculates an optimal path for the robot arm to spray the patch material to achieve a perfectly flat and very dense patch. The spray emulsion materials used with the present invention are expected to cost about the same as the lowest cost hot-mix, but extended patch life is expected with only a fraction of the installation cost.

SUMMARY OF THE INVENTION

In one embodiment, the present invention utilizes a spray patching system that permits greater control over the patch application parameters, while being used in a vehicle under the control of a single operator. The automated pavement repair vehicle (APRV) of the present invention precisely controls the temperature of the emulsion and the proportion of emulsion and aggregate in the tanks, hoses, and nozzle and pumps it through a robotic control arm under computer servo control. In application, the rock aggregate obtained from a material supply yard may be sometimes dirty, wet, and may have a coating of fine dust. The present system provides adequate controls to prevent clogging of the machine or the preparation of subpar pavement repair patches that have suboptimal lifetimes. The APRV spray patcher module provides systems and controls to tolerate the reality of poor materials and environmental conditions.

In its preferred embodiment, the APRV of the present invention includes both a vehicle and its various subsystems. The vehicle includes a full-size truck cab equipped with operator controls. A pavement cutter is located on the front end to cut the pothole in a milling operation. The pavement cutter is manipulated by a joy-stick control.

The various subsystems for completing pavement repair are located on the frame and rear of the truck. A robotic cell at the rear of the truck includes an assembly of retractable doors. The doors are lowered around the pothole to allow control of temperature and other environmental conditions during the pavement repair procedure. A vacuum system is provided for cleaning and preparation of the pothole for repair. A heating system is provided to dry and heat the pothole before application of the emulsion and aggregate. A spray patch system is provided which includes control of the mixing of aggregate and emulsion in a system which is called a velocity fill and compaction system.

A robotic control arm controls the application of the vacuum, heating and spray patch subsystems to the pavement repair area. The robotic control arm is movable in both horizontal and lateral directions to permit pavement repair over an area. A first end of the control arm pivots about a single point, or raised shaft, at the forward end of the truck near the rear of the cab. The opposite end of the control arm is movable across the lateral width of the repair area to permit application of emulsion/aggregate to a large size pothole or pavement repair area. Lateral movement of the robotic control arm is computer controlled.

The robotic control arm also includes a telescoping end, which permits horizontal movement in a forward and aft direction with respect to the vehicle. The telescoping end curves and extends in a downward direction from the truck platform. Further telescoping of the robotic control arm in a vertical direction permits raising and lowering of the end of the control arm. This vertical movement is utilized particularly with the vacuum system.

The robotic control arm combines several functions used in the pavement repair process. First, the control arm provides the above-described vacuum function in which debris is removed from the pothole and carried along the inside of a first control arm tube to the front of the truck for filtration, collection and later disposal. Second, the control arm includes a second tube for carrying propane and compressed air in the form of a heat lance for drying and heating of the pothole prior to the application of the patch emulsion material.

The robotic control arm also performs the above-described spray emulsion/aggregate application process. The aggregate travels down a third control arm tube and is combined with asphalt emulsion which is sent through a separate conduit to the end of the control arm. The robotic control arm is linked to the control system to provide single operator control of all of these systems, and additional systems, from the safety of the cab.

A three-dimensional laser radar vision system and a two-dimensional vision system are both used in conjunction with the robotic control arm. The vision system scans the pothole and provides the necessary information to allow precise movement of the control arm and precise application of spray emulsion to the pothole. The vision system also monitors the repair function and provides quality data recording.

A computer control system provides control of the entire system. The computer system gathers the data from the three-dimensional imaging of the pothole and provides an output control of the robotic control arm to provide the pothole vacuum function, pothole heating function, and pothole spray emulsion application function. The control system also provides information to the single operator about equipment and conditions, as well as provide control of the retractable doors and other vehicle functions.

The present invention also includes improved processes for application of spray emulsion. Use of the vehicle of the present invention, or any of the subsystems, alone or in combination with the vehicle, or the use of any of the processes of the present invention, is expected to provide advantages over the pavement repair apparatus and processes of the prior art.

BRIEF DESCRIPTION OF THE DRAWINGS

For a more complete understanding of the invention, one should refer to the embodiments illustrated in greater detail in the accompanying drawings and described below by way of examples of the invention. In the drawings, which are not to scale.

DETAILED DESCRIPTION OF THE DRAWINGS

Figure 1:
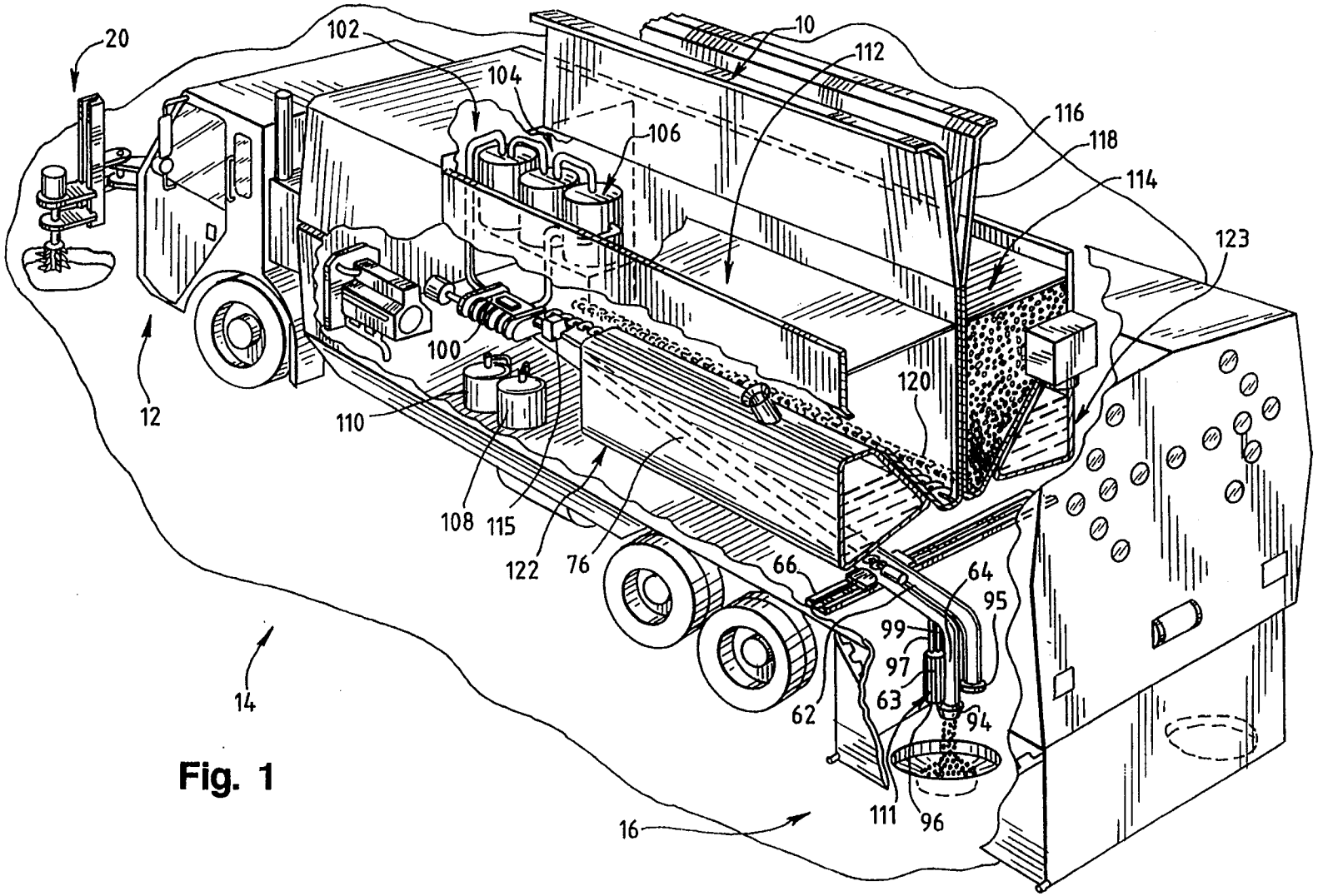
FIG. 1 is a perspective view of one embodiment of the APRV of the present invention, illustrating certain systems in phantom outline.
Figure 3:
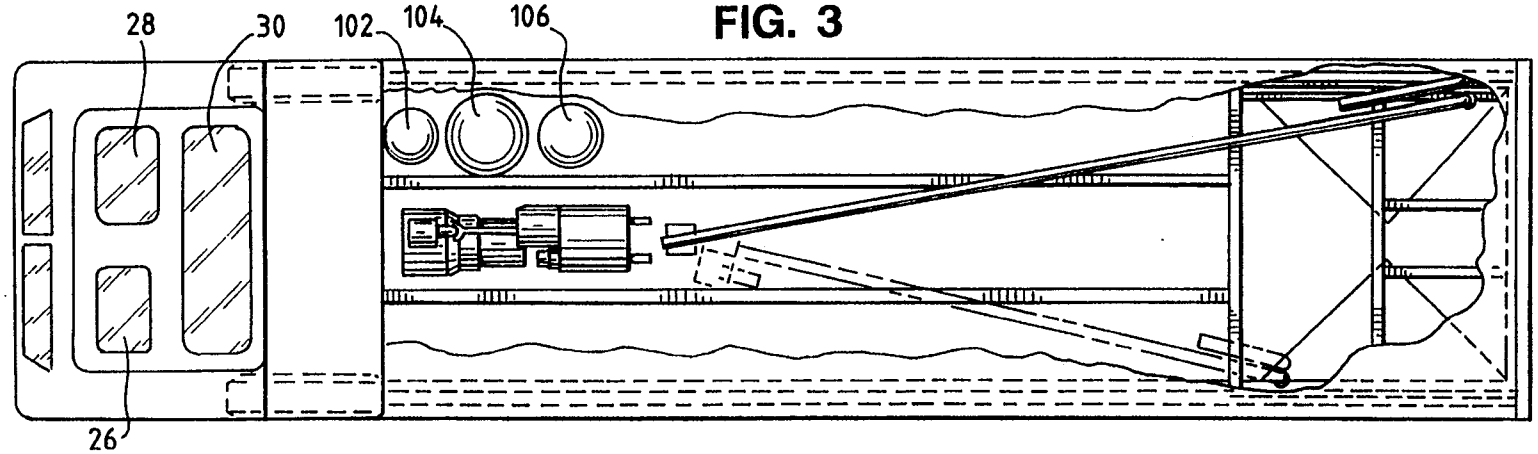
FIG. 3 is a plan view of the APRV of FIG. 2.
Figure 2:
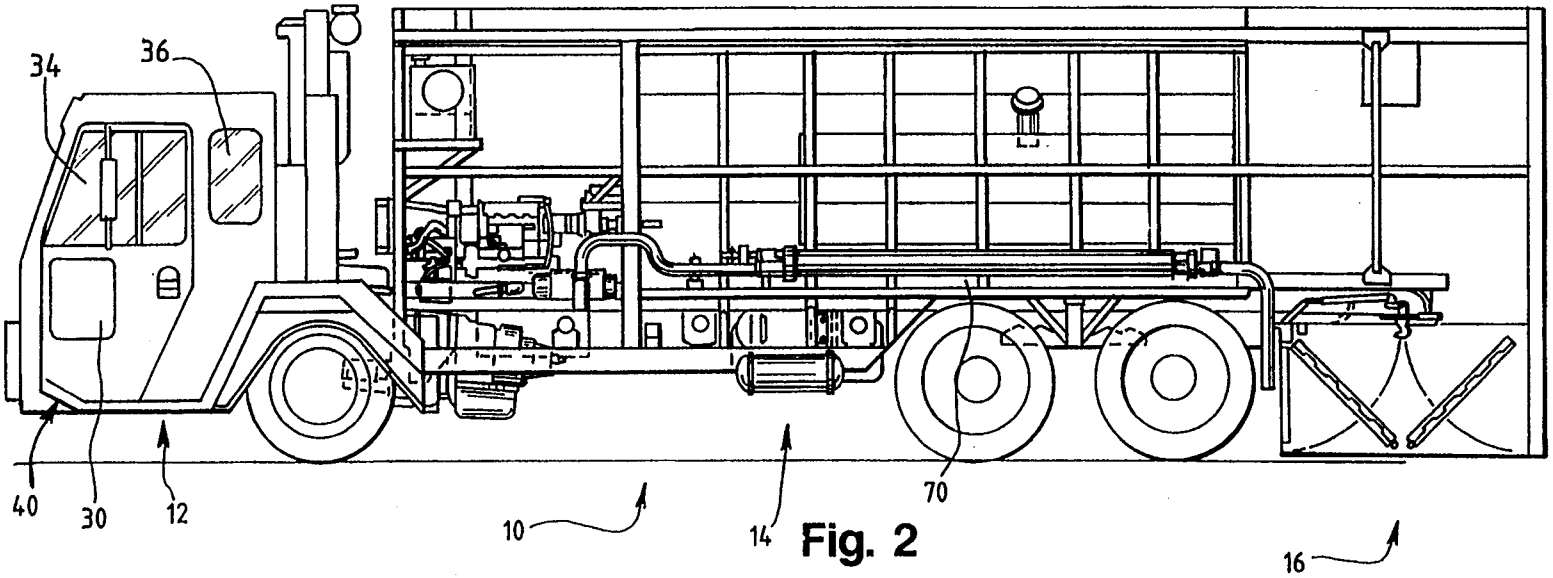
FIG. 2 is a side view of the APRV of the present invention, illustrating components in phantom outline.

Turning now to the drawings, one embodiment of the automated pavement repair vehicle (APRV) 10 of the present invention is shown in perspective view in FIG. 1. The vehicle 10 includes a cab section 12, main body or truck section 14, and rear section 16. The rear section is attached to the truck and includes a work cell or work area. The cab and truck are shown in more detail in FIG. 3, while the rear section is shown in more detail in FIGS. 4 and 5.

The truck, in its preferred embodiment, is mounted on a truck chassis made by Crane Carrier Company (CCC). The truck frame is formed of structural steel, heat treated and then straightened to eliminate racking and twisting problems. Ten inch rails extend from the front bumper to the tailboard. Standard heavy duty electrical systems and air brake systems, as well as other chassis systems, known to those in the vehicle art, are specified for this application.

The truck 14 features a front-mounted power-take-off (PTO) that drives the hydraulic system 20 for pavement cutting and auger/screw conveyor for aggregate supply. The removable pavement cutting system 20 is shown in FIG. 1. The pavement cutting system features a hydraulic controlled cutter, which is available from Crafco of Phoenix, Ariz. While shown in the milling position, an alternative cutter may be utilized with the cutting being done in the horizontal direction, i.e., a planar or planing operation. The cutter is preferably operated by a joy-stick control in the control panel of the cab. The cutter control is included in the overall control system for the APRV.

A rear-mounted power-take-off system powers a 500 cubic foot per minute blower. A generator set provides, preferably, at least 15 kilowatts of electrical power for the computer systems, lighting, vision systems, and sensors. The vehicle chassis will preferably handle a gross weight of 59,000 pounds for full load conditions. The vehicle preferably includes a wheel base of 200 inches, body width of 8 feet, and height of 10 feet, in order to satisfy the present legal requirements for overall vehicle size in every state of the United States.

Although a single driver is the only required operator, a crew cab is provided for additional crew or observers on day-long repair excursions. The cab 12 includes operator seating location 26, and crew locations 28, 30. The cab-over-engine design allow maximum operator visibility of the pavement. Broad front windows 32, door windows 34, and rear windows 36 are designed to allow maximum operator visibility. The computers and displays (not shown) in the crew cab 12 are shock-mounted in a cabinet for extra protection. The cab includes tilt features to allow maintenance and access to the engine and PTO systems. The hydraulic cutter will swing laterally to allow tilting of the cab for maintenance purposes.

An optional camera (not shown) may be located on the front in order to further assist the operator in the location of the pothole for the cutting operation.

A light bar (not shown) may also be located on the front of the cab to enhance operator visibility of the pothole at night.

After the pothole has been located and cut, as described more fully below in the discussion of the operation, the vehicle is moved forward so that the work area cell 16 covers the pothole area. The work area is preferably spaced 8 feet wide to cover the width of a standard highway lane. A preferred five foot length to the work area provides forty square feet of work area. The work area enclosure 16 is intended to protect the pothole and work area from the environment during pothole repair and allow some element of control over the temperature, moisture, and other environmental conditions at the pothole. Thus, the work area can allow use of the emulsion/aggregate patch material in cold or warm weather conditions by control of the environmental conditions inside the work area.

Figure 5:
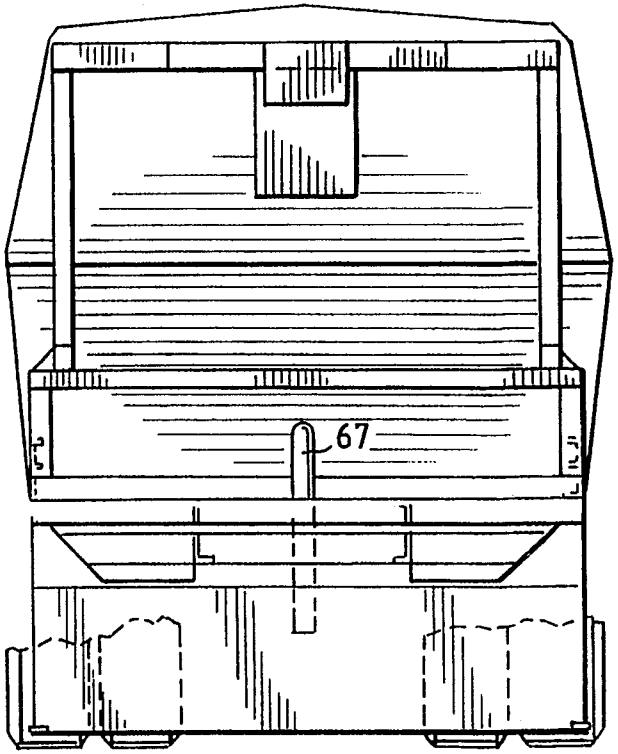
FIG. 5 is a rear view of the APRV illustrating the doors of the work area in the retracted position.
Figure 4:
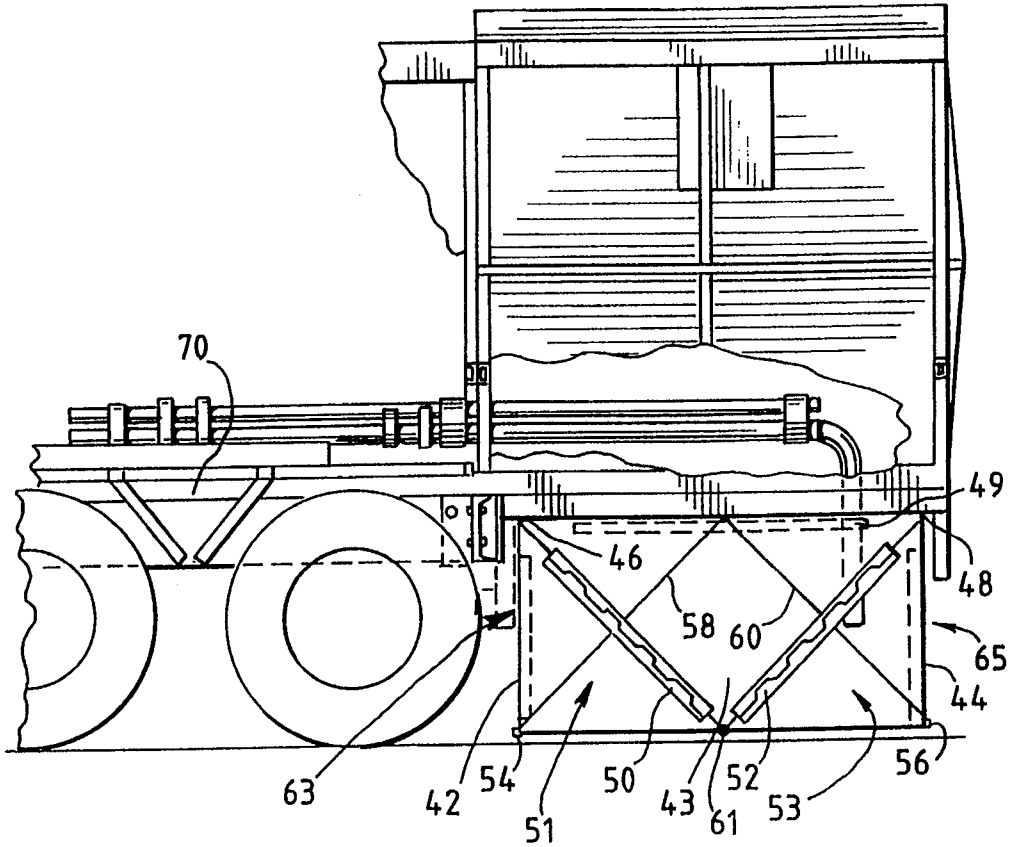
FIG. 4 is a side view of the rear of the APRV illustrating the doors of the work area in the lowered position.

The work area cell 16 includes an assembly of retractable doors. Each assembly includes foldable walls which collapse or fold when the doors are retracted. As shown in FIGS. 4 and 5, the folding door or wall portions are connected by hinges. Each side of the vehicle has a similar system, with dual walls along the front and rear of the work area and the front of the truck, each designed to fold beneath the side doors.

Each side door has a first triangular portion 43 that is bounded by upper points 46, 48 and lower point 61. Upper points 46 and 48 are at the ends of upper hinge 49, which allows pivoting of the first triangular portion inward about the bottom of the fixed work box. The sides of first triangular portion 43 include hinges 50 and 52.

The hinges 50, 52 each form a connection with one edge of each second triangular portion 51 and third triangular portion 53. Second triangular portion 51 is bounded by points 46, 54 and 61, and includes hinge 42 joining 51 and front panel 63. Third triangular portion 53 is bounded by points 48, 56 and 61, and includes a hinge 44 joining 53 and rear end panel 65. Panels 63, 65, respectively, form the front and rear panels of the foldable area of the work area box. The front and rear end panels are not hinged at the top. The front and end panels are hingedly connected to each side door.

Cylindrical rod members 58, 60 extend from points 54 and 56, respectively, and connect with vertical pole (not shown) at the point where 58 and 60 are close together.

Retraction of the doors is initiated by movement or vertical pull on rod ends at the top or closed position. Such movement causes upward movement of rods 58, 60 and corresponding movement of points 54, 56, which are positioned on swivel ends. Upward movement of rods 58, 60 causes a bending along hinges 49, 50 and 52. The bending permits an inward movement of triangle 43 and similar movement of triangles 51 and 53. As the rods proceed vertically, triangle 43 moves to a horizontal position below the truck main body. Triangles 51 and 53 then each move to a horizontal position below triangle 43. Finally, the front and rear end panels move inward to a horizontal position below triangles 51 and 53. In this manner, the side and end panels of the box are fully retracted, as shown in FIG. 5. To lower the box, the vertical pull portion is lowered and the reverse process, or unfolding, takes place.

Figure 6:
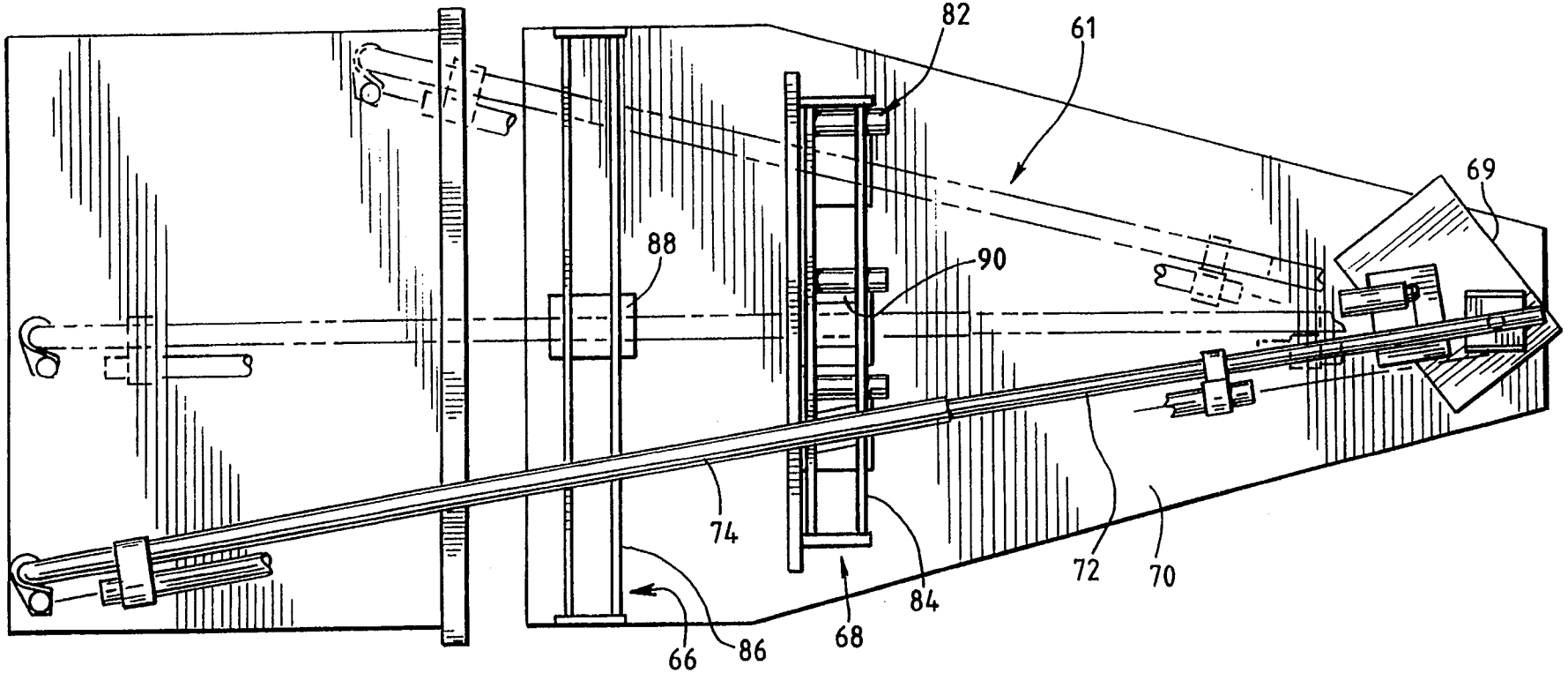
FIG. 6 is a plan view of the platform illustrating the various lateral positions of the robotic control arm.
Figure 7:
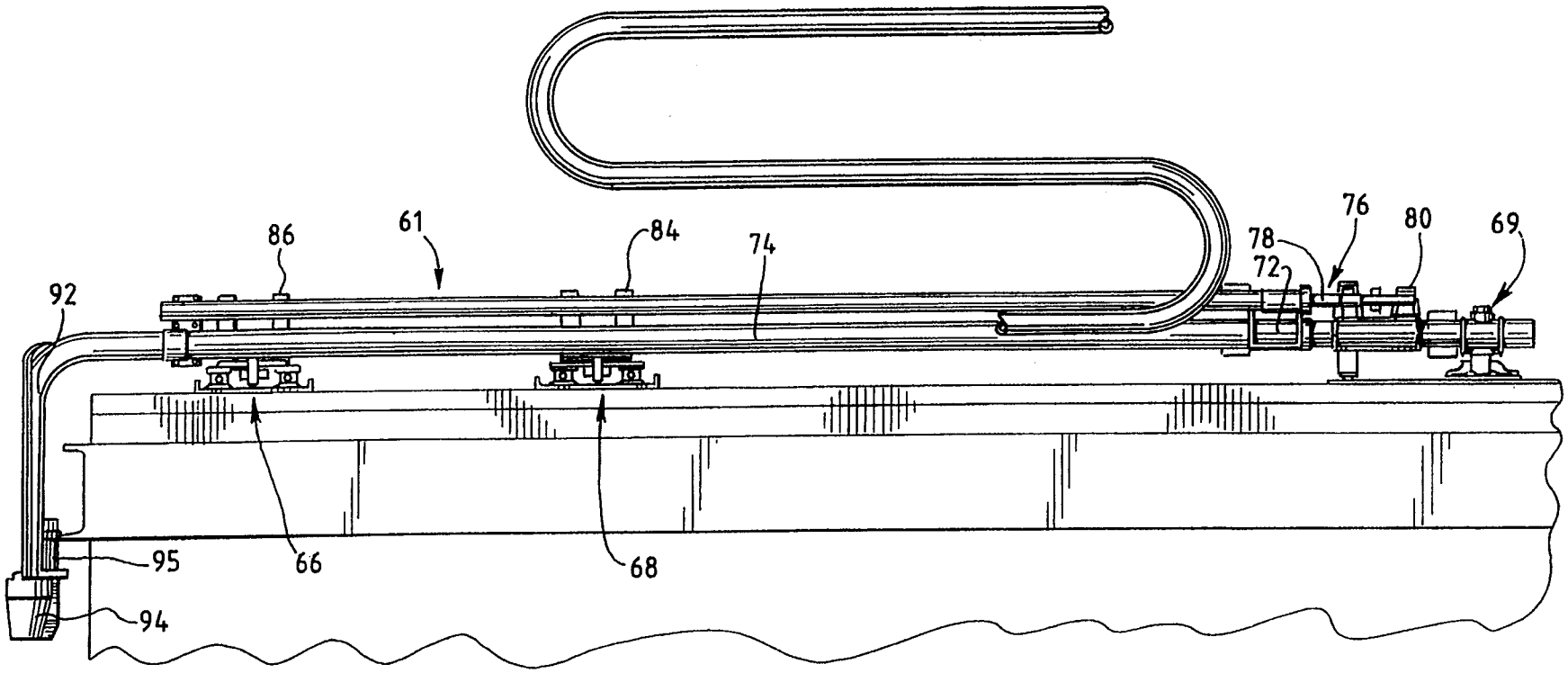
FIG. 7 is a side view of the robotic control arm of FIG. 6.

The truck portion 14 of the APRV includes the robotic arm system 61, as shown in FIGS. 6 and 7. The robotic control arm system 61 forms the base component for the vacuum cleaning system, heating system and spray patch filling system. As shown in FIG. 1, a first control arm tube 62 provides the vacuum system; a second control arm tube 63 provides the heating system; and, a third control arm tube 64 provides the spray patch filling system. The control arm tubes are interconnected as part of the overall operator control system. The interrelationship of the systems and the robotic control arm is further illustrated in the block diagram of FIG. 9. The robotic control arm may also be controlled by a joystick control from the cab.

As shown in FIG. 6, the robotic control arm system 61 pivots around a fixed shaft 69. Two track systems 66, 68 provide the control the bounds of the lateral movement of the control arm 62 on the trailer platform.

The plurality of robotic control arms are described in terms of a single construction. Each robotic control arm includes a forward portion 72 that is telescoped within a rearward portion 74. Movement of horizontal screw system 76 pushes the rearward portion 74 along the forward portion 72, which causes extension of the robotic control arm toward the rear of the vehicle. The screw system 76 includes a threaded shaft 78 and fixed end 80. Rotation of the threaded shaft causes an extension of the telescoping rearward portion of the robotic control arm. Rotation is controlled by an electric motor driven by the robot controller 228, which receives electric power from a truck carried generator set.

Either of track systems 66 and 68 may include a chain and sprocket drive system 82 to move the robotic control arm laterally along the pairs of parallel tracks 84, 86. Guide portions 88, 90 travel along the length of the pairs of parallel tracks 84, 86 in response to the actuation of the chain and sprocket systems 82. The chain and sprocket system are each driven by individual electric motors. Movement of the guide portions 88, 90 along the tracks causes corresponding lateral movement of the robotic control arm along the platform. The robotic control arm telescopes as the arm sweeps laterally along the platform. The lateral movement and the telescoping movement is sufficient to allow full movement of the end of the control arm through the work area.

The robotic control arm includes a shaft portion 92 which carries aggregate to the nozzle portion 94. Nozzle 94 is extendible downward from the truck platform level in order to approach the pothole. As described below, as the aggregate is about to exit the nozzle, the asphalt emulsion is added directly to the aggregate.

A vacuum system allows the removal of particles from the pothole through a separate nozzle 95 and through the control arm tube or shaft 93, shown in FIG. 1. Alternately, the particle removal and vacuum could be through the same nozzle and shaft as used for the spray patch system. As described below, the particles are removed from the pothole and sent to a filtration system and then stored for later disposal.

An additional conduit or control arm tube 96 is connected to the robotic control arm and nozzle to provide the hot air lance for heating the pothole. The propane and compressed air are each supplied through separate conduits 97, 99, from tanks 108, 110 to the combustion chamber. The details of the hot air lance assembly are set forth in U.S. Pat. No. 4,798,530 to Sestrap, which is incorporated herein by reference.

The vacuum system that operates with the robotic control arm is utilized to clean the pothole before it is repaired. Manual cleaning of potholes with brooms and shovels provides minimal effectiveness in producing a clean pothole for repair. Moreover, prior art systems that utilize compressed air blowing result in dirt and dust clouds that provide safety and environmental concerns.

The vacuum system of the present invention employs an "elephant trunk" nozzle 95 of flexible hose that is extendible to the bottom-most portions of the pothole. The system uses a positive displacement blower 100 to draw the particles from the pothole into the vacuum tube or hose 93 of the robotic control arm. The positive displacement blower also provides the pressurized air source for the spray patch system. The blower provides a pressurized air source, and vacuum source, both of which have an ambient air vent. The vacuum tube or hose 93 delivers the particles from the pothole to a triple filtration system, illustrated as canisters 102, 104, 106. Canister 102 is preferably a cyclone filter which removes approximately 98% of the material, with the heavier material dropping to the bottom of the canister, for disposal through a waste hopper 103. Canister 104 is preferably a labyrinth filter. Canister 106 is then a final protective filter to prevent water mist and dust from reaching the inlet of the blower. Use of the triple filtration system is expected to alleviate environmental concerns with prior art blower systems by trapping the particles and dust in the canister bins for later disposal. The vacuum tube or hose is also used for cleaning of the pothole area after completion of the pothole repair.

The heating system that is employed with the robotic control arm is utilized to heat and dry the pothole before repair. Without drying of the pothole, the pothole may include moisture which is detrimental to achieving optimal repair. Additionally, without heating, the temperature of the pothole may differ significantly from the temperature of the repair mix. Such a differential can also prevent the proper bonding and curing and be detrimental to overall repair quality.

The heat lance 96 provides the heating of the pothole until the pothole is substantially dry and the upper edges of the pothole are approximately the same temperature as the emulsion mix. The positioning of the heat lance is controlled by the location of the robotic control arm. Actuation of the heat lance is controlled by the control system. Compressed air tank 108 and propane tank 110, which are shown in FIG. 1, are connected by appropriate regulators, valves and conduit to the combustion chamber 111 of the heat lance. Although illustrated separately in FIG. 9, the combustion chamber 111 and heat lance 96 are preferably formed in a single unit, as shown in FIG. 1.

The spray patch filling system that is employed with the robotic control arm is utilized to fill the pothole and provide the repair. The filling system uses a velocity fill and compaction system that supplies high velocity aggregate and asphalt emulsion. The aggregate is stored in two large hoppers or bins 112, 114, shown in FIG. 1. The bins 112, 114 are located near the upper portion of the vehicle. The bins have recessed bottoms to permit ease of downward exiting of material. Gull wing doors 116, 118 are provided on the tops of the bins to permit access of a loader with materials.

A plurality of bins are provided in order to permit addition of different sized aggregate to the pothole. Preferably, larger sized aggregate is provided at the bottom of the pothole to permit greater strength of the repair mix. Finer sized aggregate is provided at the top of the pothole to permit a smooth surface at the top. The two different sized aggregates may also be mixed and applied simultaneously or follow one after the other during the repair. Other materials may be introduced into the airstream carried by conduit 92, such as fibers or recycleable materials.

Figure 10:
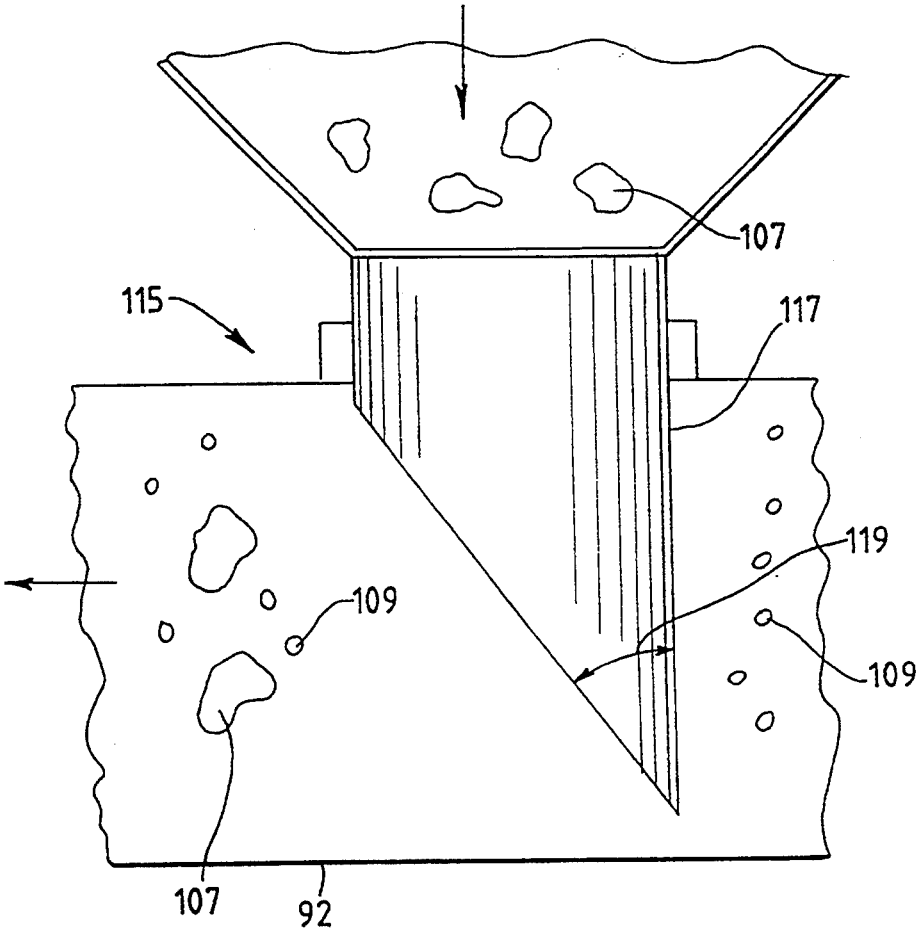

An auger 120 is located at the bottom of each bin 112, 114 to carry the aggregate 107 to the exit port 115. The exit port 115, shown in FIG. 10, includes a tube 117 that is placed within the conduit 92 of the robotic control arm. Air 109 from the positive displacement blower passes by the exit port tube and draws aggregate into the control arm conduit 92 and toward the nozzle. The angle 119 of the tube has been experimentally fixed at 37 degrees, but other angles may be utilized and still achieve the benefits of the invention. A fine mist of water or other liquid to prevent the aggregate from source 121 is placed on the aggregate as it leaves the exit port. The addition of the mist minimizes the dust particles produced by the aggregate. The mist also provides a surface moisture to help the asphalt emulsion attach to the aggregate and accelerate the curing process. Other liquids can be used to promote desirable patch properties, such as quick-set or cure.

The liquid asphalt emulsion is stored in tanks 122, 123 located on the truck main body on opposite sides of the aggregate storage bins 112, 114. The asphalt emulsion must be kept at an appropriate temperature. The emulsion is supplied to the nozzle with air pressure or a pump and then combined with the aggregate near the end of the spray patch nozzle 94 as the aggregate leaves the nozzle and is propelled into the pothole at high speed.

The present invention contemplates a preferred mixture of approximately 7% asphalt emulsion with approximately 93% aggregate. Other mixtures of emulsion and aggregate, together or in combination with other materials, are contemplated within the scope of the present invention. The present invention also preferably contemplates a substantially precise control on the rates of flow of both the aggregate and the emulsion. It is determined that an optimum flow rate for the aggregate exceeds 40 miles per hour, and may approach 100 miles per hour. These process parameters appear to optimize the velocity fill compaction method preferred with the present invention.

The filling system of the present invention also contemplates control of the amount and rate of addition of the emulsion and aggregate mix to the pothole. The velocity fill compaction method of the present invention avoids the need for further mechanical or physical compaction methods, such as the use of a steam roller or similar device.

Figure 9:
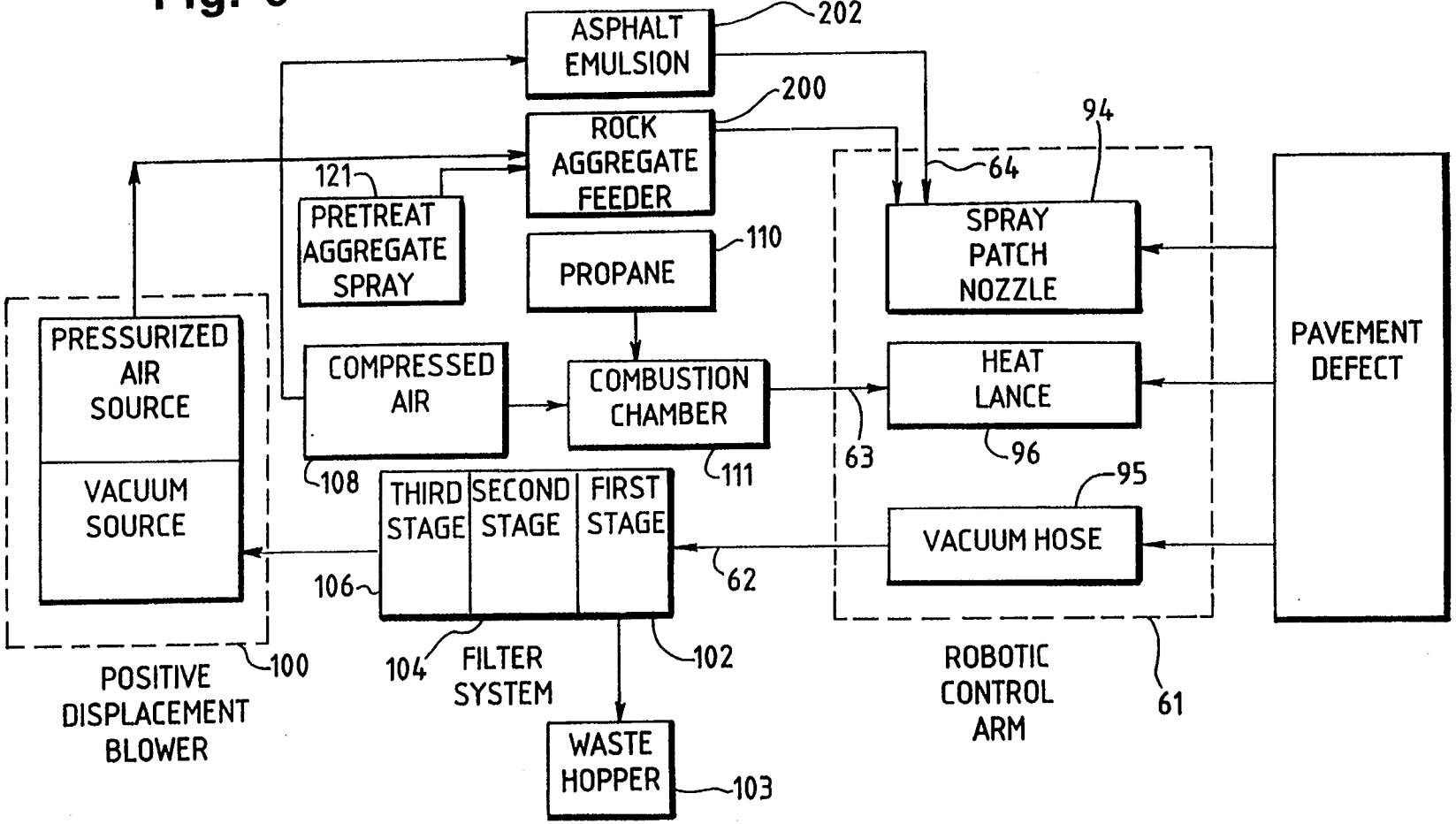
FIG. 9 is a block diagram illustrating the interaction of the vacuum system, heating system and spray application system with the robotic control arm; and, FIG. 10 is a detail view of the exit port from the aggregate bin into the conduit tube.

The interrelationship of the vacuum, heating and filling system is illustrated in the block diagram of FIG. 9. The positive displacement blower 100 provides a pressurized air source for movement of rock aggregate 107, which is combined with a pretreat aggregate spray 121, such as water mist or chemical mist, and asphalt emulsion 202 in the spray patch nozzle 94. The compressed air 108 and propane 110 are mixed in the combustion chamber 111, which preferably serves as the heat lance 96. The compressed air 108 provides a pressurized air source for the asphalt emulsion 202. The positive displacement blower 100 also provides a vacuum source for the vacuum system, which draws materials from the pothole, through the vacuum hose 95 and the three stages 102, 104, 106 of the filtration system. The spray patch nozzle 94, heat lance 96 and vacuum hose 95 each have separate conduits and are controlled by the robotic control arm system. Alternatively, all or some of the conduits may be combined in a single or dual device.

Figure 8:
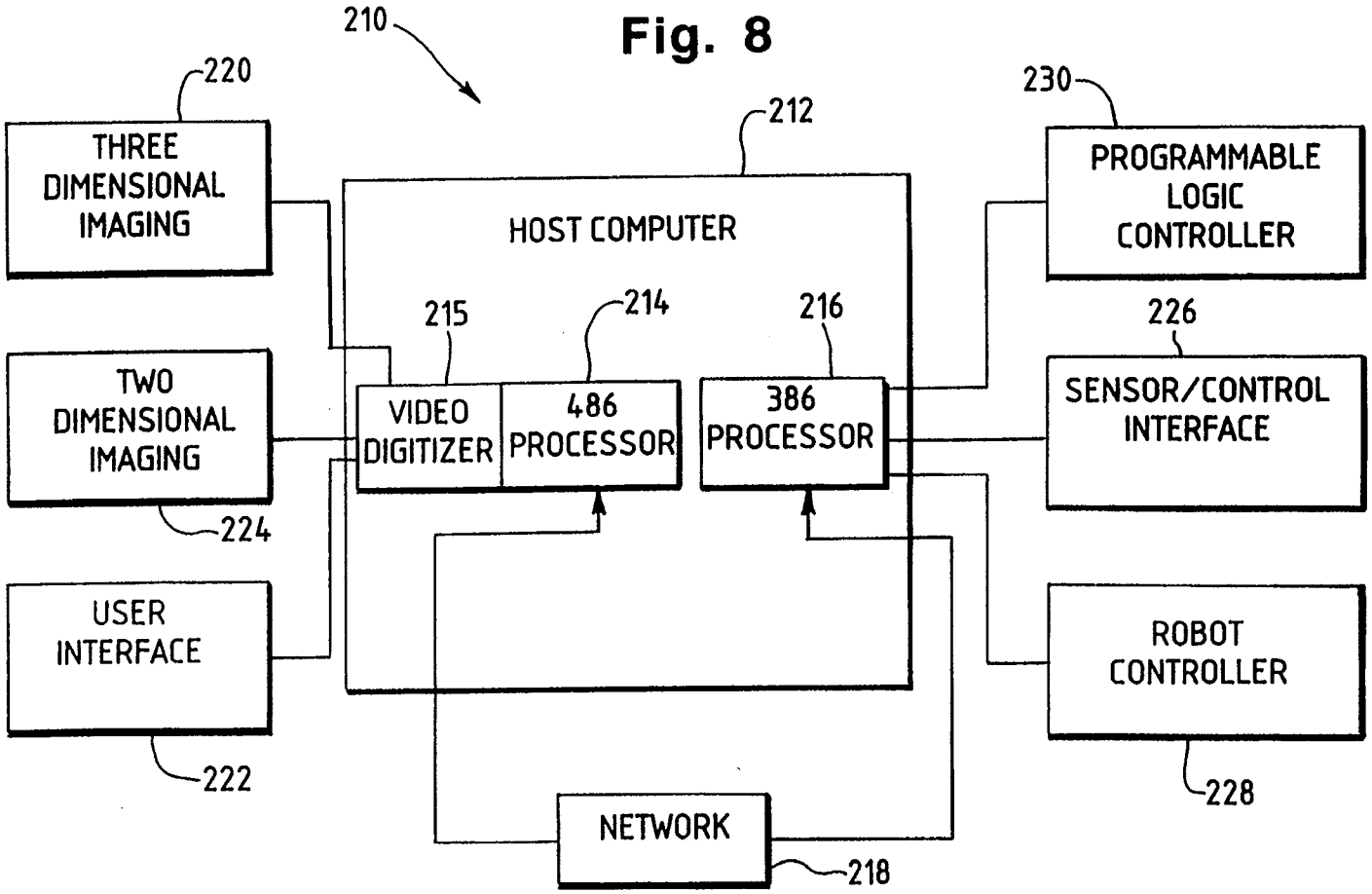
FIG. 8 is a block diagram illustrating the overall components of the control system.

The vacuum, heating and filling system of the present invention are all controlled by the control system, which is illustrated in block diagram form in FIG. 8. The control system 210 includes a host computer 212 containing a 486 microprocessor 214 networked with a 386 microprocessor 216, through network block 218.

The 486 processor receives imaging information of the geometry of the pothole. A commercial three-dimensional laser radar system 220 available from Perceptron of Detroit, Mich., is utilized to determine the geometry of the pothole by sweeping a single laser across the surface of the pothole. The radar system provides data to the 486 processor regarding the depth of the pothole and the surface characteristics through gray scale imaging. The 486 processor also receives input from the user interface 222 in the operator control panel of the cab. A video digitizer (frame grabber) digitizes analog signals from the two-dimensional imaging system 224 for processing by the 486 processor 214 and display by the user interface 222. The three dimensional imaging system 220 of the present invention communicates with the 486 processor. The operator is able to view the repair area through a camera mounted in the rear work area of the vehicle. The camera also provides a two dimensional imaging input 224 to the 486 processor. The laser radar system is also mounted above the rear work area.

The 386 processor includes inputs from sensors and operator controls 226. The 386 processor provides the output control of the robotic control arm through a robotic controller 228. The robotic controller actuates the various motors in the robotic control arm, as necessary in the repair operation. A programmable logic controller 230 is also included in the system 210. The programmable logic controller receives inputs from various sensors located on the equipment of the APRV.

The design of the APRV provides a number of advantages over prior art pavement repair systems. The APRV is designed to allow full pavement repair by a single operator. Moreover, all equipment is controlled from within the cab of the vehicle in conjunction with a central computer control system.

Since most industrial accidents happen during equipment maintenance, lowering maintenance frequency actually improves safety. Safety interlocks in the APRV prevent the crew from exposing themselves to risks of operation. Since the single crew member never needs to leave the cab, there is great potential to reduce traffic related injuries when using this system. The APRV of the present invention allows pavement repair under difficult environmental conditions, particularly on cold and rainy days. The versatile design of the APRV accommodates a variety of sizes and shapes of potholes and other pavement defects. Also, the system of the present invention can be used for multiple purposes besides pothole repair, such as crack sealing, utility cut patching, concrete spall repair, or shoulder reconstruction.

The gull-wing doors over the dual 13 foot aggregate hoppers permit a 12 foot wide loader to dump a bucket directly into each of the 4 cubic yard hoppers with minimal spillage. The covers prevent weather spoilage of the aggregate during storage and improve the aerodynamics and safety of the system in transport. Heavy-duty edges prevent accidental damage from the loader. The dual emulsion tanks each have a capacity of 180 gallons. They are heated electrically and they may also be kept warm with engine heat during operation. Moreover, maintaining the emulsion temperature between 120 to 180 degrees Fahrenheit prevents clogging and improves the controlled flow of the emulsion and speeds its cure time. The side panels of the APRV and access doors of the emulsion tanks can also be pivoted or removed for easy cleaning.

Operation of the APRV

Many states have specified pothole repair procedures. These repair procedures vary, as well as the equipment and materials used to perform them. In operation, the following sequence of steps allows the APRV to repair most types of potholes in accordance with generally accepted repair procedures:

Step 1: The driver locates a pothole using his eyes and the downward-pointing CCD camera looking through the windshield. With the cab-over-engine design of the truck, the operator can see a point on the road two feet in front of the plane of the windshield. A front-mounted light-bar can be used at night to assist viewing of the potholes. The camera system may also be used to create a photographic log for pavement distress recording.

Step 2: The driver uses the joystick control to manipulate the bumper-mounted pavement cutter to clean and shape the edges of a pothole. This step is optional for those states that require pothole cutting. As described above, a hydraulic-operated cutter supplied by Crafco of Phoenix Ariz., which uses a vertical-milling principle, is sufficient for this operation. The cutter head contains many carbide-tipped bits that can be easily replaced in the field. It is rotated at high speed to achieve the great shear forces needed to cut asphalt pavement. Although maneuvered by joystick located in the cab, the cutter may be fully computer-automated. The cutter can shape the edges of a 4 square foot pothole in a few minutes. The hydraulic arm of the pavement cutter is mounted on the front bumper of the truck.

Step 3: Following completion of cutting of the pothole, the APRV is then driven forward slowly about 33 feet until the pothole is positioned under the repair box work area at the rear of the truck. Exact alignment is not required and the computer vision system will provide assistance. The repair box work area houses a 2-dimensional and a 3-dimensional vision system, pyrometer, robotic arm, vacuum system, and a hot air lance. The retractable doors on the underside of the box unfold to pavement level to keep weather conditions away from the repair as it is made. The doors also confine the repair process and materials to a local area thus minimizing the effect over the traveling public.

Step 4: The three-dimensional laser-radar vision system located inside the repair box scans the pavement area under the box to detect the depressed area of the pothole as well as cracks. Scanning the pothole by laser light allows it to be seen in great detail, even in changing lighting conditions. The laser system is eye-safe. The laser system shows the operator a three-dimensional graphic display of the pothole surface, including accurate readings of the depths and overall dimensions. The laser system also sends this data to the control system to perform the rest of the repair sequence. After a brief scan, the data is converted to motion trajectories for the robot to follow under PID-type control.

Step 5: The telescoping robotic arm extends from its rest position and moves a vacuum nozzle down into the cavity. The robotic arm is capable of both lateral and horizontal movement to cover the entire base of the pothole. High power vacuum created by the intake of the 500 cubic foot per minute blower sucks out water, mud, and cutter debris, and existing road debris very rapidly. Enough power is available to also suck up large asphalt chunks although larger pieces are screened to prevent clogging and remain in the hole as base material. The vacuum system has three stages of filtration which empty into a waste hopper which is dumped from the passenger side once per day or less. The filtration protects the blower intake from receiving damaging dust and water from the pothole vacuuming process. Maintenance of this component should be very infrequent and involve simple and inexpensive filter replacement. Sensors are provided to detect worn or damaged filters and an hour meter is used to indicate amount of use and thus indicate the need for preventative maintenance.

Step 6: The control system then ignites the hot air lance and the robotic control arm moves a hot air lance across the pothole surface to heat the surface and bonding edges of the cavity and substantially dry the pothole. An electrical ignition and gas control system operates with a command from the computer or button start. The lance is powered by liquid propane and compressed air but it may, alternatively, use compressed natural gas or other similar gaseous fuels. The system has no open flames, yet exit temperatures can reach over 1800 degrees Fahrenheit. The temperature of the pavement is closely monitored by a pryometer located in the repair box to assure that no overheating of the pavement takes place. The control system monitors the pavement temperature and moves the robotic control arm and heating lance accordingly. Larger areas will require back and forth movement of the lance to distribute the heat evenly.

Step 7: Once the pothole is shaped, clean, dry and appropriately heated, the next step is the application of patch material. The spray patch system (as described in a preceding section) conveys rock aggregate in the size range of $\frac{1}{4}$ to $\frac{1}{2}$ inch into a high speed air stream. As the rock aggregate leaves the storage bins, it is covered with a fine mist of water to eliminate dust and/or chemicals, to speed cure of the repair mix. The rock moves down the tube of the robotic arm, makes a turn through 90 degrees, and travels to a dispensing nozzle. Just before it exits the nozzle, it is covered with asphalt emulsion, thus making the patch material on the fly. As it strikes the pothole cavity with great impact, the emulsion breaks, the patch begins to cure immediately, and air voids are eliminated as the patch is built from the bottom of the pothole to the top.

The velocity of the patch material striking the pavement is a significant factor in eliminating air voids from the patch and in promoting emulsion break which is necessary for cure. Optimized design can provide very high impact speeds of nearly 100 mph. The overall material discharge rate is preferably about one cubic foot per minute and is controllable by computer control of the augers in the hoppers and the emulsion orifices and/or pumps.

The dual aggregate and emulsion systems are also independently powered and controlled. One hopper may contain a coarse aggregate for base material and the other a closed graded aggregate for surface patching. Alternately, two different material systems can be carried on board to allow for experimental patching in the same location as a control patch. Other aggregate-like materials or fibers can also be used to replace or supplement the rock aggregate in the patching mix.

Step 8: After the computer has controlled the filling of the pothole cavity, vacuum system of the robotic arm can vacuum away any over spray from the patching process, thus leaving the repair site substantially clean. A video record may also be made of the process to ensure that a quality patch was made. The doors of the work area are then retracted and on a signal the driver may move forward to the next pothole at highway speeds. Enough material and waste storage may be maintained onboard to allow all day operation without replenishment or dumping.

Thus, an automated pavement repair vehicle has been described, including various subsystems of the vehicle. Methods of pavement repair are also described and variations on the use of materials.

While several embodiments of the invention are illustrated, it will be understood that the invention is not limited to these embodiments. Those skilled in the art to which the invention pertains may make modifications and other embodiments employing the principles of this invention, particularly upon considering the foregoing teachings.

What is claimed is:

1. A spray patch application system for repairing pavement defects, comprising:

a source of aggregate addition;

a source of asphalt emulsion addition;

an application conduit, said application conduit providing mixing and transport of said aggregate addition and said emulsion addition to a pavement defect;

said application conduit being an extended tube of substantially cylindrical shape ending in a nozzle portion, said emulsion being added to said aggregate addition in said application conduit, said aggregate being drawn into and transported through said application conduit by air passing through said application conduit;

a moveable control arm system, said control arm system having an application control arm positioned for horizontal and vertical movement, said application conduit forming a portion of said application control arm;

a regulation mechanism, said regulation mechanism providing a control of the rate of flow through said application conduit, said flow rate through said application conduit being controlled to have particles of said aggregate exceed a speed of 90 miles per hour, said regulation mechanism providing a control of the mixture of said aggregate addition and said asphalt emulsion addition.

2. The spray patch application system of claim 1 wherein said mixture is controlled to provide an amount of said aggregate addition of greater than 90% of said mixture.

3. The spray patch application system of claim 1 wherein said control arm system includes a control arm having a telescoping portion and a vertical extending portion, said vertical extending portion being downwardly extendible from a vehicle platform.

4. The spray patch application system of claim 1 wherein said application system includes a vacuum system, said vacuum system including a vacuum source, a storage container, a vacuum conduit, and a hose portion, said vacuum conduit connecting said hose portion to said storage container to provide a passageway for materials from said hose portion to said storage container, said hose portion and said vacuum conduit forming a portion of a vacuum control arm system.

5. The spray patch application system of claim 4 wherein said storage container includes a filtration system.

6. The spray patch application system of claim 4 wherein said vacuum control arm and said application arm are connected to a single moveable arm unit.

7. The spray patch application system of claim 6 wherein said single moveable arm unit has extendible and retractable portions and is positioned for horizontal and vertical movement.

8. The spray patch application system of claim 1 wherein said application system includes a heating system, said heating system including a heating lance, said heating lance forming a portion of said control arm system.

9. The spray patch application system of claim 1 wherein said application system is transported on a vehicle frame, said vehicle frame including a front cab portion, and a rear portion, said vehicle frame including ground contacting wheeled members and capable of movement at highway speeds.

10. The spray patch application system of claim 9 wherein said application system is mounted on said rear portion of said vehicle frame.

11. A spray patch application system for repairing pavement defects, comprising:

a source of aggregate addition;

a source of asphalt emulsion addition;

an application conduit, said application conduit providing mixing and transport of said aggregate addition and said emulsion addition to a pavement defect;

a moveable control arm system, said control arm system having an application control arm positioned for horizontal and vertical movement, said application conduit forming a portion of said application control arm;

a regulation mechanism, said regulation mechanism providing a control of the rate of flow through said application conduit, said regulation mechanism providing a control of the mixture of said aggregate addition and said asphalt emulsion addition;

said application system being transported on a vehicle frame, said vehicle frame including a front cab portion, and a rear portion, said vehicle frame including ground contacting wheeled members and capable of movement at highway speeds;

said application system being mounted on said rear portion of said vehicle frame;

said vehicle rear portion including a retractable door assembly positioned to include at least portions of a pavement defect.

12. A method of repairing a pavement defect, comprising:

locating the pavement defect;

vacuuming the internal portion of the defect to remove materials;

heating the defect area with a hot air lance;

mixing aggregate and asphalt emulsion in an application conduit prior to addition of said aggregate and said emulsion to said pavement defect; said application conduit being an extended tube of substantially cylindrical shape ending in a nozzle portion, said aggregate being drawn into and transported through said application conduit by air passing through said application conduit;

regulating said mixing and said transport of said aggregate and said asphalt emulsion by a regulation mechanism, said regulation mechanism providing a control of the rate of flow through said application conduit, said flow rate through said application conduit being controlled to have particles of said aggregate exceed a speed of 90 miles per hour, said regulation mechanism providing a control of the mixture of said aggregate addition and said asphalt emulsion addition; and, filling said pavement defect with said mixture of said aggregate and said emulsion.

13. The method of claim 12 wherein said mixing step is controlled to provide an amount of said aggregate of greater than 90% of said mixture.

* * * * *